US011273537B2

(12) United States Patent
Rentz

(10) Patent No.: US 11,273,537 B2
(45) Date of Patent: Mar. 15, 2022

(54) MANUAL SWING CLAMP

(71) Applicant: Delaware Capital Formation, Inc., Wilmington, DE (US)

(72) Inventor: Matthew Rentz, Shelby Township, MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 150 days.

(21) Appl. No.: 16/549,098

(22) Filed: Aug. 23, 2019

(65) Prior Publication Data

US 2020/0070317 A1 Mar. 5, 2020

Related U.S. Application Data

(60) Provisional application No. 62/723,517, filed on Aug. 28, 2018.

(51) Int. Cl.
*B25B 5/10* (2006.01)
*B25B 5/12* (2006.01)
*B25B 5/06* (2006.01)

(52) U.S. Cl.
CPC ..... *B25B 5/105* (2013.01); *B25B 5/12* (2013.01); *B25B 5/062* (2013.01)

(58) Field of Classification Search
CPC .. B25B 5/105; B25B 5/12; B25B 5/10; B25B 5/104; B25B 5/125
USPC ..... 269/228, 238, 239, 24
See application file for complete search history.

(56) References Cited

U.S. PATENT DOCUMENTS 3,222,054 A * 12/1965 Bisulca ..... B25B 5/06 269/93
4,351,516 A 9/1982 Ersoy et al.
4,508,327 A 4/1985 Ersoy
5,005,468 A * 4/1991 Ulle ..... B25B 5/062 74/99 A
5,013,015 A 5/1991 Fatheree
5,192,058 A 3/1993 VanDalsem et al.
5,820,118 A 10/1998 Craft
(Continued)

FOREIGN PATENT DOCUMENTS

CN 203189376 U 9/2013
CN 203670347 U 6/2014
EP 2602060 A1 6/2013

OTHER PUBLICATIONS

European Search Report in corresonding European Applicatiion No. 19193783.8 dated May 11, 2020.

*Primary Examiner* — Seahee Hong
(74) *Attorney, Agent, or Firm* — Harness, Dickey & Pierce, P.L.C.

(57) ABSTRACT

A swing clamp includes a body with a first end and second end. The body defines a bore through the first end and a cavity at the second end. The bore is in communication with the cavity. A plunger is slidably and rotatably held in the body bore. A lever is pivotally connected to the second end. A link arm pivotally connects between the plunger and the lever. A housing includes an attachment portion and a cylindrical portion. The cylindrical portion includes a bore to enable passage of the plunger. A groove is formed in an inner surface of the bore. The groove guides a pin coupled with the plunger. A clamp finger is secured on the end of the plunger. The clamp finger rotates as the plunger is moved in the bore.

12 Claims, 5 Drawing Sheets

(56) References Cited

U.S. PATENT DOCUMENTS

| | | | | |
|---|---|---|---|---|
| 5,904,349 | A * | 5/1999 | Dykstra | B25B 5/12 269/228 |
| 6,427,992 | B1 * | 8/2002 | Noda | B25B 5/062 269/24 |
| 6,648,315 | B1 * | 11/2003 | Lee | B25B 5/068 269/166 |
| 6,648,316 | B1 * | 11/2003 | Vouland | B25B 5/12 269/24 |
| 2009/0152784 | A1 | 6/2009 | Yonezawa et al. | |

* cited by examiner

MANUAL SWING CLAMP

CROSS-REFERENCE TO RELATED APPLICATION

This application claims the benefit of U.S. Provisional Application No. 62/723,517, filed on Aug. 28, 2018. The entire disclosure of the above application is incorporated herein by reference.

FIELD

The present disclosure relates to plunger clamps and, more particularly, to a plunger clamp including a swing clamping finger.

BACKGROUND

Plunger clamps exist in the art. Plunger clamps provide a lever arm connected to a linkage to move a cylinder plunger. The plunger clamps provide a mechanical advantage so not to overstress the linkage. One such plunger clamp is illustrated in U.S. Pat. No. 5,904,349 assigned to the assignee of the present disclosure, which is incorporated herein by reference.

However, designers strive to have a manual clamp that provides a swing arm. This enables the arm to rotate around the plunger axis to enable desired movement and clamping arm.

SUMMARY

It is an objection of the present disclosure to provide a plunger clamp with a swing clamping arm. The mechanism to enable the rotation of the plunger is provided with a protective cover. The cover prevents access to the groove in the housing that enables the rotational movement of the plunger.

Accordingly to the first objective of the present disclosure, a manual swing clamp comprises a body having a first end and a second end. The body defines a bore through the first end and a cavity at the second end. The bore communicates with the cavity. A plunger is slidably and rotatably held in the bore of the body. A lever is pivotally connected at the second end. A link arm pivotally connects between the plunger and lever. A housing is coupled with the first end of the body. The housing includes first and second cylinders. The first cylinder includes a slot to receive a pin coupled with the plunger. The second cylinder is coaxially positioned about the first cylinder to provide a cover. A clamp finger is secured on an end of the plunger. The clamp finger rotates as the plunger is moved in the first cylinder. A snap ring secures the second cylinder onto the first cylinder. A set screw secures the second cylinder with the first cylinder. One of the first or second cylinders include a radial flange. The first or second cylinders include an internal thread to couple with the threaded end of the body. The slot provides left or right hand rotation of the plunger.

Accordingly to a second objective of the invention, a swing clamp comprises a body having a body having a first end and second end. The body defines a bore through the first end and a cavity at the second end. The bore is in communication with the cavity. A plunger is slidably and rotatably held in the bore of the body. A lever is pivotally connected to the second end. A link arm pivotally connects between the plunger and the lever. A housing includes an attachment portion and a cylindrical portion. The cylindrical portion includes a bore to enable passage of the plunger. A groove is formed in an inner surface of the bore. The groove guides a pin coupled with the plunger. A clamp finger is secured on the end of the plunger. The clamp finger rotates as the plunger is moved in the bore.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
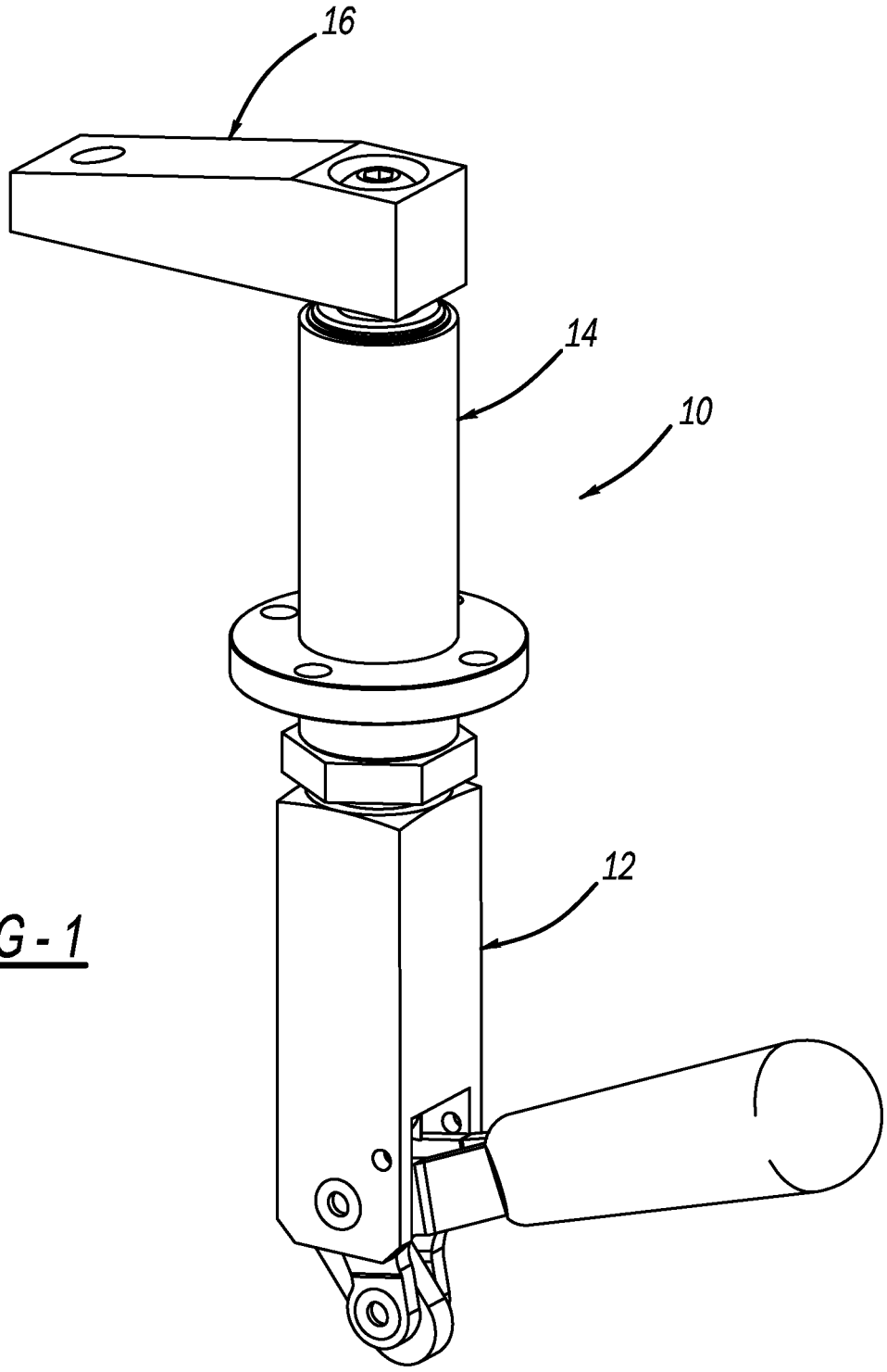
FIG. 1 is a perspective view of a manual swing clamp in accordance with the disclosure.
Figure 2:
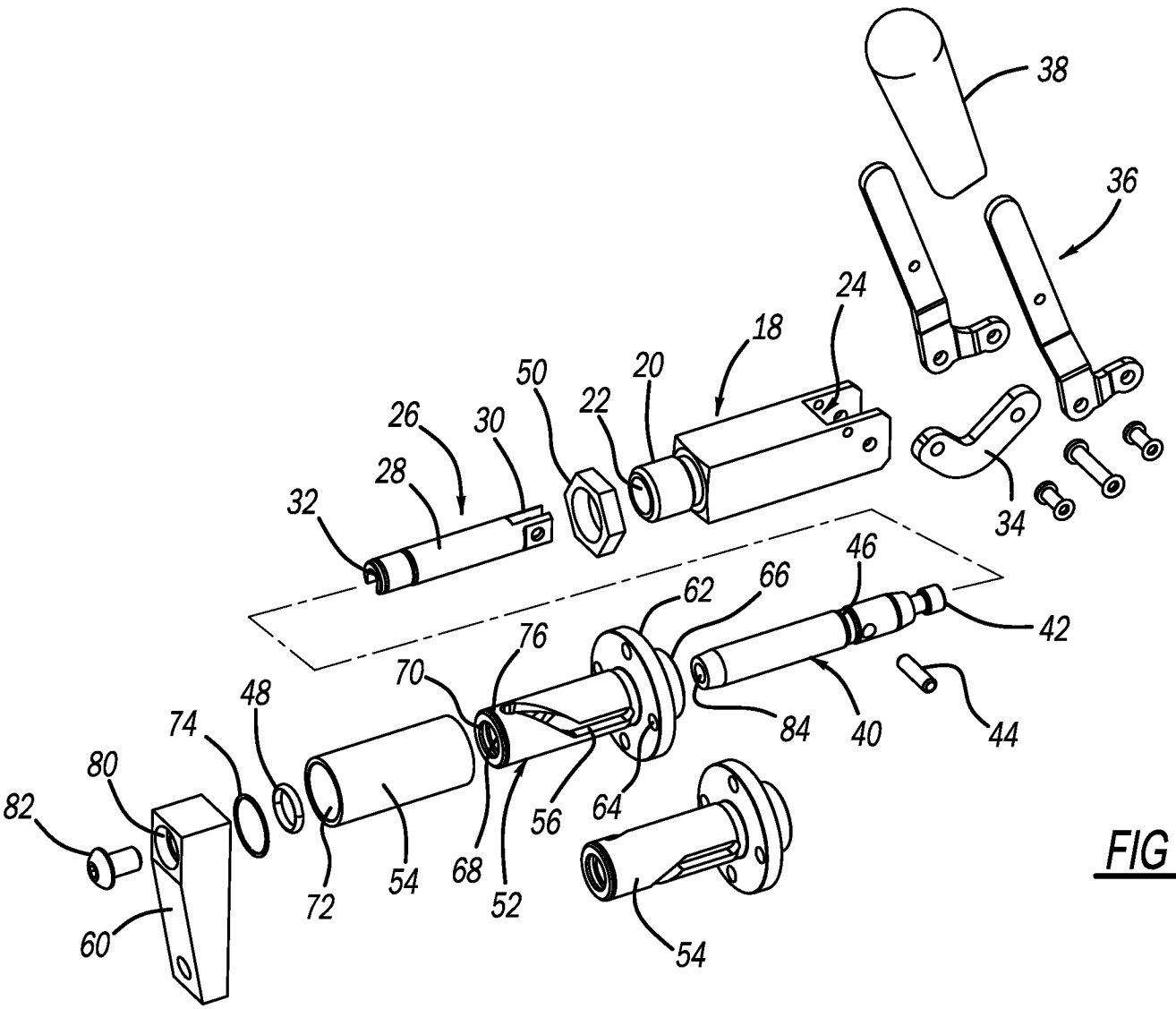
FIG. 2 is an exploded view of FIG. 1.

Example embodiments will now be described more fully with reference to the accompanying drawings.

Turning to the figures, a manual swing clamp is illustrated and designated with the reference numeral 10. The swing clamp includes a plunger clamp 12, a housing 14 and a clamping finger 16.

Figure 3:
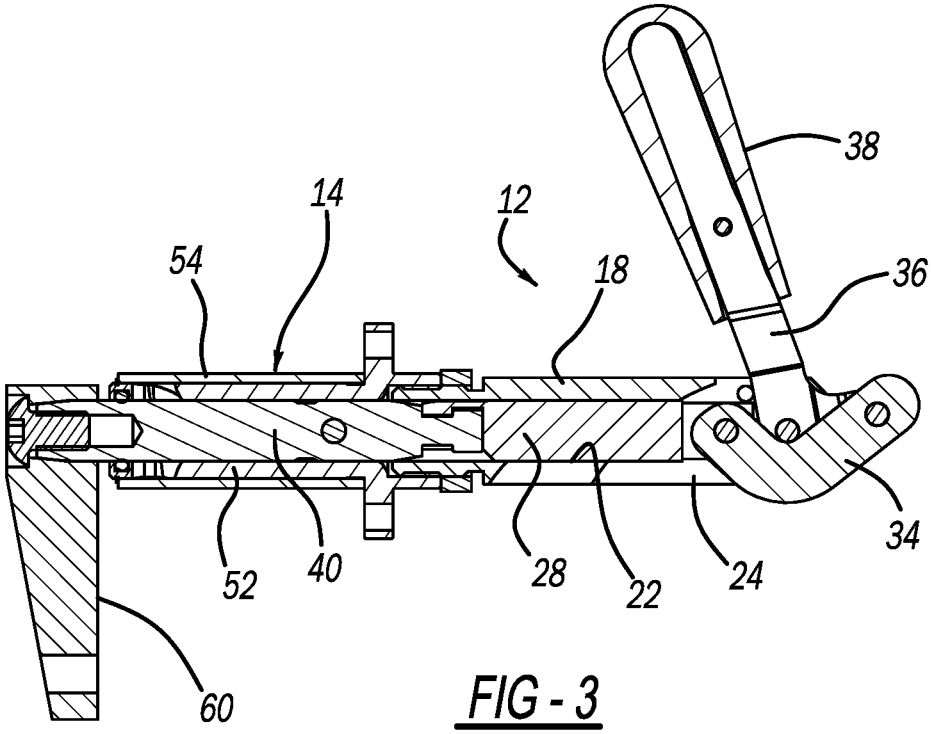
FIG. 3 is a cross-section view of FIG. 1.
Figure 4:
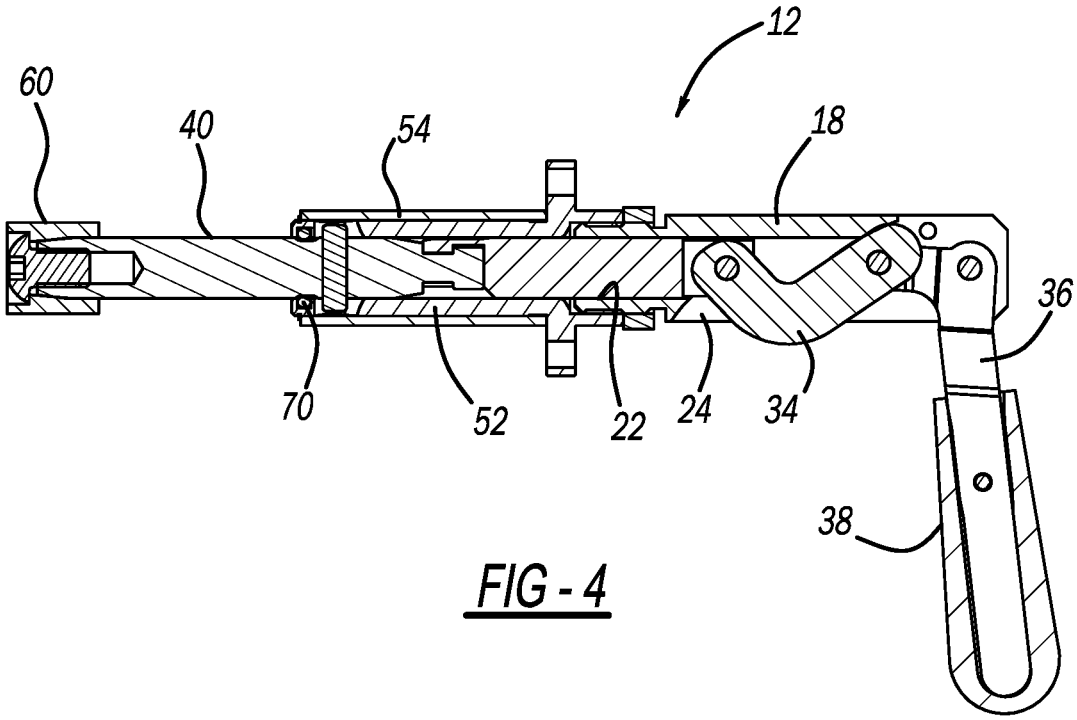
FIG. 4 is a cross-section view like that of FIG. 3 in an opened position.

The plunger clamp 12 includes a body 18 with a threaded end 20. The body includes a bore 22 extending into the body 18 and a cavity 24. The bore 18 and cavity 24 communicate with one another. A two piece plunger 26 is inserted into the bore 22. The first rod portion 28 includes a pivot connection end 30 and a rotation end 32. The pivot end 30 is connected with a link arm 34 which, in turn, is connected with a bifurcated lever 36. The bifurcated lever 36 includes a handle 38 maintaining the levers together. A plurality of pins 35 are utilized passing through holes in the body to retain the levers on the body. Additionally, the link arm 34 is connected with the link end 30 of the first plunger 28. The ends of the levers 36 are connected with the other end of the link arm 34. Thus, as the handle 38 is moved between positions, as illustrated in FIGS. 3 and 4, the plunger 26 is moved in the body as well as the clamping finger 16 is moved from an open to a closed position.

The second rod 40 of the plunger 26 includes a coupling end 42. Coupling end 42 rests in the rotation end 32 of the first plunger rod 28 to enable rotation of the second plunger rod 40 in the first plunger rod 28. A pin 44 is passed through the second plunger rod 40 to couple with the housing 14. Additionally, the second plunger rod 40 includes a circumferential groove 46 that receives an O-ring 48. The O-ring 48 provides additional environmental protection. Additionally, the O-ring 48 acts as a detent to keep the clamp in an open position when unclamped by resting in the groove 46 on the second plunger rod 40. A nut 50 can be secured onto the threaded end 20 to adjust the axial length of the housing 14.

The housing 14 includes a first cylinder 52 and a second cylinder 54. The first cylinder 52 includes a groove or slot 56. The groove or slot 56 can be either of a design that enables right or left hand rotation of the second plunger rod.

A pin 44 is positioned in the slot 56. As the plunger 26 is moved through the body 18, the pin 44 moves along the slot 56. As this occurs, the swing arm finger 60 rotates between an opened and closed position. The first cylinder portion 52 includes a flange 62. The flange 62 is provided with apertures 64 so that the flange can be rotated and tightened onto the threaded end 20 via the internal thread 66 on the first cylinder 52. Also, the flange 62 enables fasteners to pass through the apertures 64 to secure the flange 62 to a work table or the like. The first cylinder 52 includes a bore 68 that enables the plunger 26 to slide in the first cylinder 52 as well as the housing 14. Additionally, the first cylinder portion includes a groove 70 in the bore 68 to provide a seating portion for the O-ring 48.

The second cylinder 54 is positioned over the first cylinder 52. The first and second cylinders are coaxially positioned with respect to one another. The second cylinder 54 generally is a closed cylinder and covers the slot of the first cylinder 52. The second cylinder 54 is a right circular cylinder including a bore 72. The bore 72 enables the second cylinder to slide and rotate on the first cylinder 52. A snap ring 74 mates in an outer surface groove 76 of the first cylinder 52 to maintain the second cylinder 54 on the first cylinder 52.

The swing clamp finger 60 includes an aperture 80 that receives a fastener 82. The fastener 82 threads into a bore 84 on the second plunger rod 40. This secures the swing clamp finger 60 with the second plunger rod 40. As can be seen in FIGS. 3 and 4, the clamp 10 is moved from a clamping position to an open position. As this occurs, the plunger rod 26 moves through the body bore 22. Also, the second plunger rod 40 is rotated in a slot 56 so that the swing arm finger 60 rotates between a first and second position. In a lock position, the finger 60 is generally extended from the clamp 10 to contact a clamping surface. In an open condition (in FIG. 4), the clamp is away from the workpiece enabling removal of the workpiece.

Figure 5A:
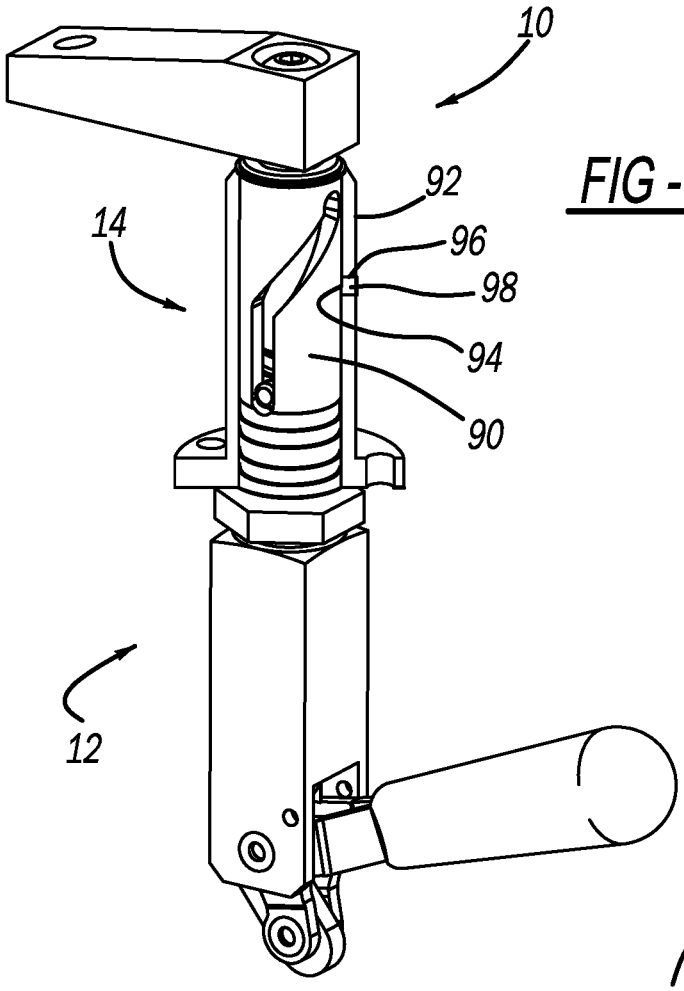
FIGS. 5A, 5B and 5C are partially cross-section views of a second embodiment of the disclosure.
Figure 5B:
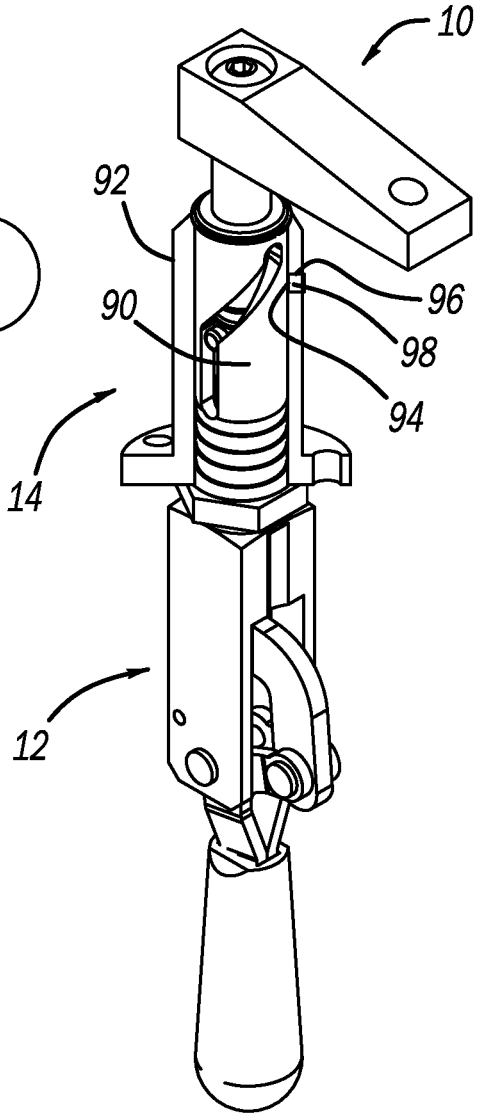
Figure 5C:
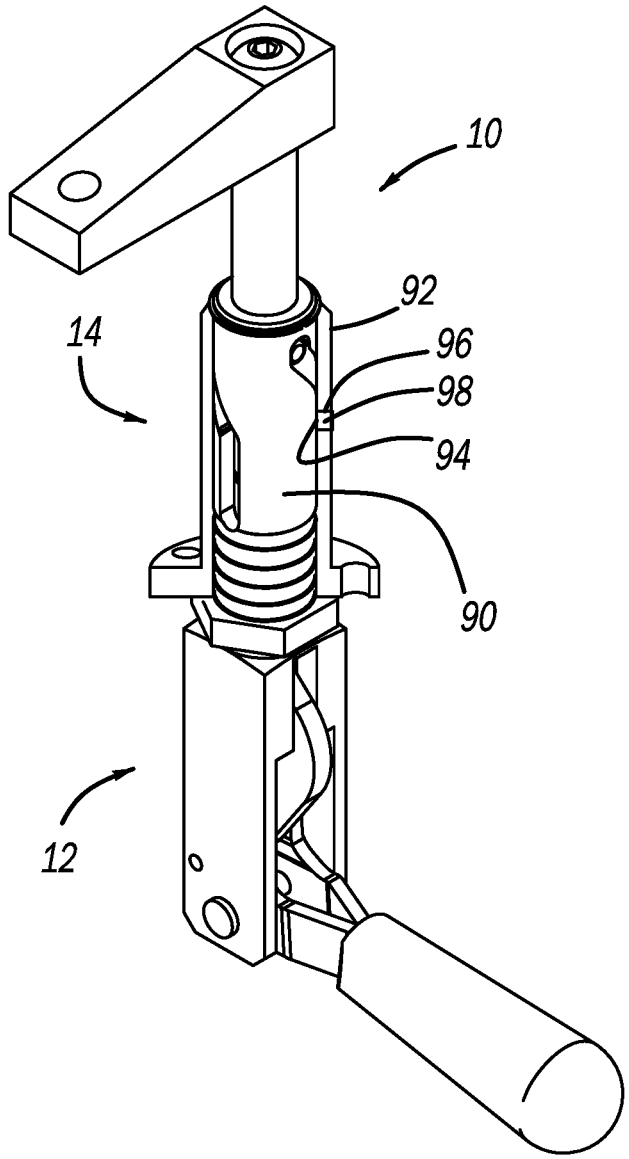

Turning to FIGS. 5A-C, an additional embodiment is illustrated. The parts which are the same are identified with the same reference numerals. The difference is between the first and second cylinders.

Here, the first cylinder 90 is positioned within the second cylinder 92. The first cylinder includes the slot 56 to receive the pin 44 as previously described. Additionally, the first cylinder 90 includes a peripheral bore 94. The peripheral bore 94 receives a set screw 96 that passes through a bore 98 in the second cylinder 92. The set screw 96 maintains the first cylinder 90 in position so that the pin 44 moves through slot 56. Additionally, the second cylinder 92 includes the flange 62 with the thread 66 to thread onto the threaded end 20 of the body. The first and second cylinders 90, 92 are co-centrically positioned with respect to one another. As the plunger clamp 12 is moved, the same movement occurs in the first and second cylinders as described above.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A manual swing clamp comprising:

a body having a first end and a second end, the body defining a bore through the first end and a cavity at the second end, the bore communicating with the cavity, a plunger slidably and rotatably held in the bore of the body;

a lever pivotally connected to the second end;

a link arm pivotally connected between the plunger and the lever, the link arm moving the plunger such that the link arm moves along the cavity during an actuation of the lever;

a housing coupled with and externally projecting away from the first end of the body, the housing including a first cylinder and a second cylinder, the first cylinder including a slot for receiving a pin coupled with the plunger, the second cylinder coaxially positioned about the first cylinder to provide a cover; and a clamp finger secured on an end of the plunger, the clamp finger rotating as the plunger is moved in the first cylinder.

2. The manual swing clamp of claim 1, further comprising a snap ring securing the second cylinder onto the first cylinder.

3. The manual swing clamp of claim 1, further comprising a set screw securing the second cylinder with the first cylinder.

4. The manual swing clamp of claim 1, wherein one of the first or second cylinders includes a radial flange.

5. The manual swing clamp of claim 1, wherein one of the first or second cylinders includes an inner thread for coupling with a threaded end of the body.

6. The manual swing clamp of claim 1, wherein the slot provides either right or left hand rotation of the plunger.

7. A manual swing clamp comprising:

a body having a first end and a second end, the body defining a bore through the first end and a cavity and the second end, the bore communicating with the cavity, a plunger slidably and rotatably held in the bore of the body;

a lever pivotally connected to the second end;

a link arm pivotally connected between the plunger and the lever, the link arm moving the plunger such that the link arm moves along the cavity during an actuation of the lever;

a housing having an attachment portion and a cylindrical portion, the housing externally projecting away from the body, the cylindrical portion including a bore enabling passage of the plunger, a groove in an inner surface of the bore of the cylindrical portion, the groove guiding a pin coupled with the plunger; and a clamp finger secured on an end of the plunger, the clamp finger rotating as the plunger is moved by the cylindrical portion.

8. The manual swing clamp of claim 7, further comprising a snap ring securing the attachment portion and the cylindrical portion.

9. The manual swing clamp of claim 7, further comprising a set screw securing the attachment portion with the cylindrical portion.

10. The manual swing clamp of claim 7, wherein one of the cylindrical portion or the attachment portion includes a radial flange.

11. The manual swing clamp of claim 7, wherein one of the cylindrical portion or the attachment portion includes an inner thread for coupling with a threaded end of the body.

12. The manual swing clamp of claim 7, wherein the groove provides either right or left hand rotation of the plunger.

* * * * *